US011067302B2

(12) United States Patent
Fradkin

(10) Patent No.: US 11,067,302 B2
(45) Date of Patent: Jul. 20, 2021

(54) SYSTEM AND METHOD FOR OPERATING A PACKAGED TERMINAL AIR CONDITIONER UNIT

(71) Applicant: Haier US Appliance Solutions, Inc., Wilmington, DE (US)

(72) Inventor: Mike Fradkin, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 519 days.

(21) Appl. No.: 15/611,854

(22) Filed: Jun. 2, 2017

(65) Prior Publication Data

US 2018/0347836 A1 Dec. 6, 2018

(51) Int. Cl.

| | |
|---|---|
| ***F24F 11/00*** | (2018.01) |
| ***F24F 1/027*** | (2019.01) |
| ***F24F 7/013*** | (2006.01) |
| ***F24F 11/56*** | (2018.01) |
| ***F24F 11/72*** | (2018.01) |
| *F24F 120/10* | (2018.01) |

(52) U.S. Cl.

CPC ..... *F24F 11/0001* (2013.01); *F24F 1/027* (2013.01); *F24F 7/013* (2013.01); *F24F 11/56* (2018.01); *F24F 11/72* (2018.01); *F24F 2011/0002* (2013.01); *F24F 2120/10* (2018.01)

(58) Field of Classification Search

CPC ..... F24F 11/0001; F24F 11/56; F24F 11/72; F24F 1/027; F24F 7/013; F24F 2011/0002; F35F 3230/10

USPC ..... 454/239

See application file for complete search history.

(56) References Cited

U.S. PATENT DOCUMENTS

| | | | | |
|---|---|---|---|---|
| 2,769,320 | A * | 11/1956 | Kuhlenschmidt | F24F 1/02 62/427 |
| 3,938,348 | A * | 2/1976 | Rickert | F24F 1/027 62/97 |
| 5,372,189 | A * | 12/1994 | Tsunekawa | F24F 1/027 62/262 |
| 6,916,239 | B2 | 7/2005 | Siddaramanna et al. | |
| 8,757,506 | B2 | 6/2014 | Zhou et al. | |
| 9,383,115 | B2 | 7/2016 | Siegel et al. | |
| 9,535,407 | B2 * | 1/2017 | Durham | G05B 13/0205 |
| 2003/0042010 | A1 * | 3/2003 | Kobayashi | F24F 1/027 165/122 |

(Continued)

FOREIGN PATENT DOCUMENTS

CN 204115156 U 1/2015

*Primary Examiner* — Kenneth J Hansen
*Assistant Examiner* — Dana K Tighe
(74) *Attorney, Agent, or Firm* — Dority & Manning, P.A.

(57) ABSTRACT

A packaged terminal air conditioner unit (PTAC) and methods for operating the same are provided. The PTAC includes a vent aperture defined in a bulkhead of the PTAC and an auxiliary fan for urging a flow of make-up air through the vent aperture. A controller is configured for obtaining a room occupancy status from an occupancy system and determining a target make-up air flow rate based on the room occupancy status. The controller operates an exhaust fan, such as a bathroom fan, to urge a flow of exhaust air through an exhaust duct at an exhaust flow rate and operates the auxiliary fan to urge the flow of auxiliary air at an auxiliary flow rate, the auxiliary flow rate being substantially equivalent to the target make-up air flow rate minus the exhaust flow rate.

18 Claims, 9 Drawing Sheets

(56) References Cited

U.S. PATENT DOCUMENTS

| | | | | |
|---|---|---|---|---|
| 2004/0168461 | A1* | 9/2004 | Park | F24F 1/027<br>62/262 |
| 2008/0156891 | A1* | 7/2008 | Zhou | F24F 1/027<br>236/44 C |
| 2010/0277306 | A1* | 11/2010 | Leinen | G08C 17/00<br>340/539.3 |
| 2011/0155365 | A1* | 6/2011 | Wiese | F24F 7/013<br>165/244 |
| 2017/0176027 | A1* | 6/2017 | Eicher | F24F 13/24 |
| 2017/0198934 | A1* | 7/2017 | Shaffer | F24F 1/027 |

* cited by examiner

SYSTEM AND METHOD FOR OPERATING A PACKAGED TERMINAL AIR CONDITIONER UNIT

FIELD OF THE INVENTION

The present disclosure relates generally to air conditioner units, and more particularly to packaged terminal air conditioner units and related methods of operation.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. PTACs often need to draw air from the outdoor portion into the indoor portion. Accordingly, certain PTACs allow for the introduction of make-up air into the indoor space, e.g., through a vent aperture defined in the bulkhead that separates the indoor and outdoor side of the unit. The vent aperture is usually equipped with an auxiliary fan and/or make-up air module to urge a flow of make-up air from the outdoor side of the PTAC into the conditioned room.

The amount of outdoor air, i.e., "make-up air," needed varies depending on a variety of factors, such as the number of room occupants, the size of the room, etc. For example, government regulations or building codes may specify the amount of make-up air required for each room occupant. In certain situations, the auxiliary fan may not be capable of providing a sufficient flow rate of make-up air to meet the room requirements. Alternatively, the auxiliary fan may generate too much noise or consume too much energy when trying to supply higher flow rates of make-up air.

Accordingly, improved air conditioner units and methods for providing make-up air would be useful. More specifically, a packaged terminal air conditioner unit that can supply the requested make-up air while reducing auxiliary fan noise and energy usage would be particularly beneficial.

BRIEF DESCRIPTION OF THE INVENTION

The present subject matter provides a packaged terminal air conditioner unit (PTAC) and methods for operating the same. The PTAC includes a vent aperture defined in a bulkhead of the PTAC and an auxiliary fan for urging a flow of make-up air through the vent aperture. A controller is configured for obtaining a room occupancy status from an occupancy system and determining a target make-up air flow rate based on the room occupancy status. The controller operates an exhaust fan, such as a bathroom fan, to urge a flow of exhaust air through an exhaust duct at an exhaust flow rate and operates the auxiliary fan to urge the flow of auxiliary air at an auxiliary flow rate, the auxiliary flow rate being substantially equivalent to the target make-up air flow rate minus the exhaust flow rate. Additional aspects and advantages of the invention will be set forth in part in the following description, may be obvious from the description, or may be learned through practice of the invention.

In accordance with one embodiment, a packaged terminal air conditioner unit for providing a flow of make-up air into a room is provided. The packaged terminal air conditioner unit includes a bulkhead defining an indoor portion and an outdoor portion, a vent aperture defined in the bulkhead, and an auxiliary fan positioned proximate the vent aperture and being configured for urging the flow of make-up air from the outdoor portion through the vent aperture to the indoor portion. A controller is operably coupled to an occupancy system, the auxiliary fan, and an exhaust fan. The controller is configured for obtaining a room occupancy status from the occupancy system and determining a target make-up air flow rate based on the room occupancy status. The controller operates the exhaust fan to urge a flow of exhaust air through an exhaust duct at an exhaust flow rate and operates the auxiliary fan to urge the flow of auxiliary air at an auxiliary flow rate, the auxiliary flow rate being substantially equivalent to the target make-up air flow rate minus the exhaust flow rate.

In accordance with another embodiment, a method of operating a packaged terminal air conditioner unit is provided. The packaged terminal conditioner unit includes an auxiliary fan positioned proximate a vent aperture defined in a bulkhead of the packaged terminal air conditioner unit. The method includes obtaining a room occupancy status and determining a target make-up air flow rate based on the room occupancy status. The method further includes operating an exhaust fan to urge a flow of exhaust air through an exhaust duct at an exhaust flow rate and operating the auxiliary fan to urge a flow of auxiliary air at an auxiliary flow rate, the auxiliary flow rate being substantially equivalent to the target make-up air flow rate minus the exhaust flow rate.

In accordance with still another embodiment, an air conditioning system for a room is provided. The air conditioning system includes a packaged terminal conditioner unit including an auxiliary fan positioned adjacent a vent aperture defined in a bulkhead of the packaged terminal air conditioner unit. An exhaust fan is positioned within the room and is in fluid communication with an exhaust duct. An occupancy system is includes for determining a room occupancy status. A controller is configured for obtaining the room occupancy status from the occupancy system and determining a target make-up air flow rate based on the room occupancy status. The controller operates the exhaust fan to urge a flow of exhaust air through the exhaust duct at an exhaust flow rate and operates the auxiliary fan to urge a flow of auxiliary air at an auxiliary flow rate, the auxiliary flow rate being substantially equivalent to the target make-up air flow rate minus the exhaust flow rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
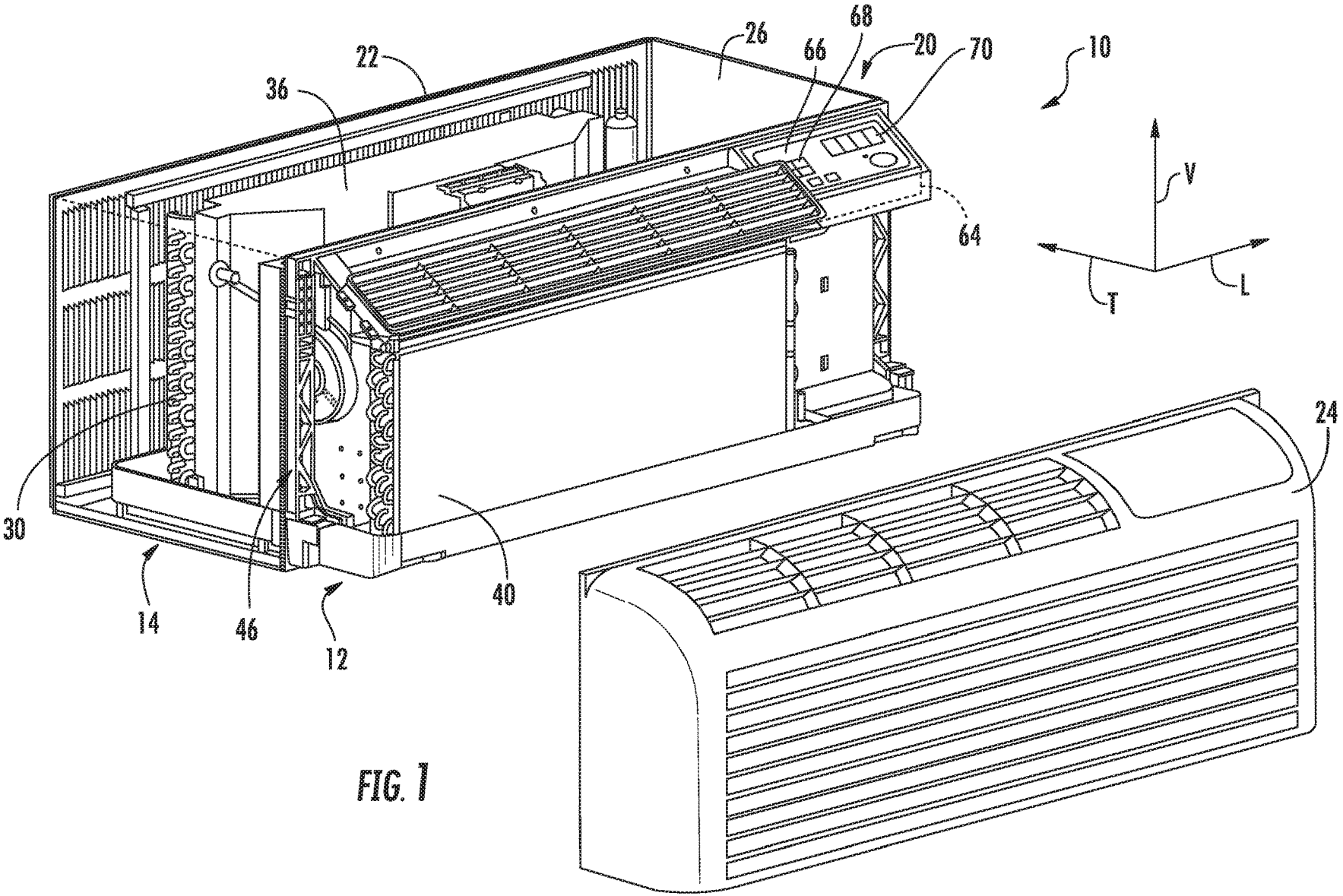
FIG. 1 provides a perspective view of an air conditioner unit, with part of an indoor portion exploded from a remainder of the air conditioner unit for illustrative purposes, in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
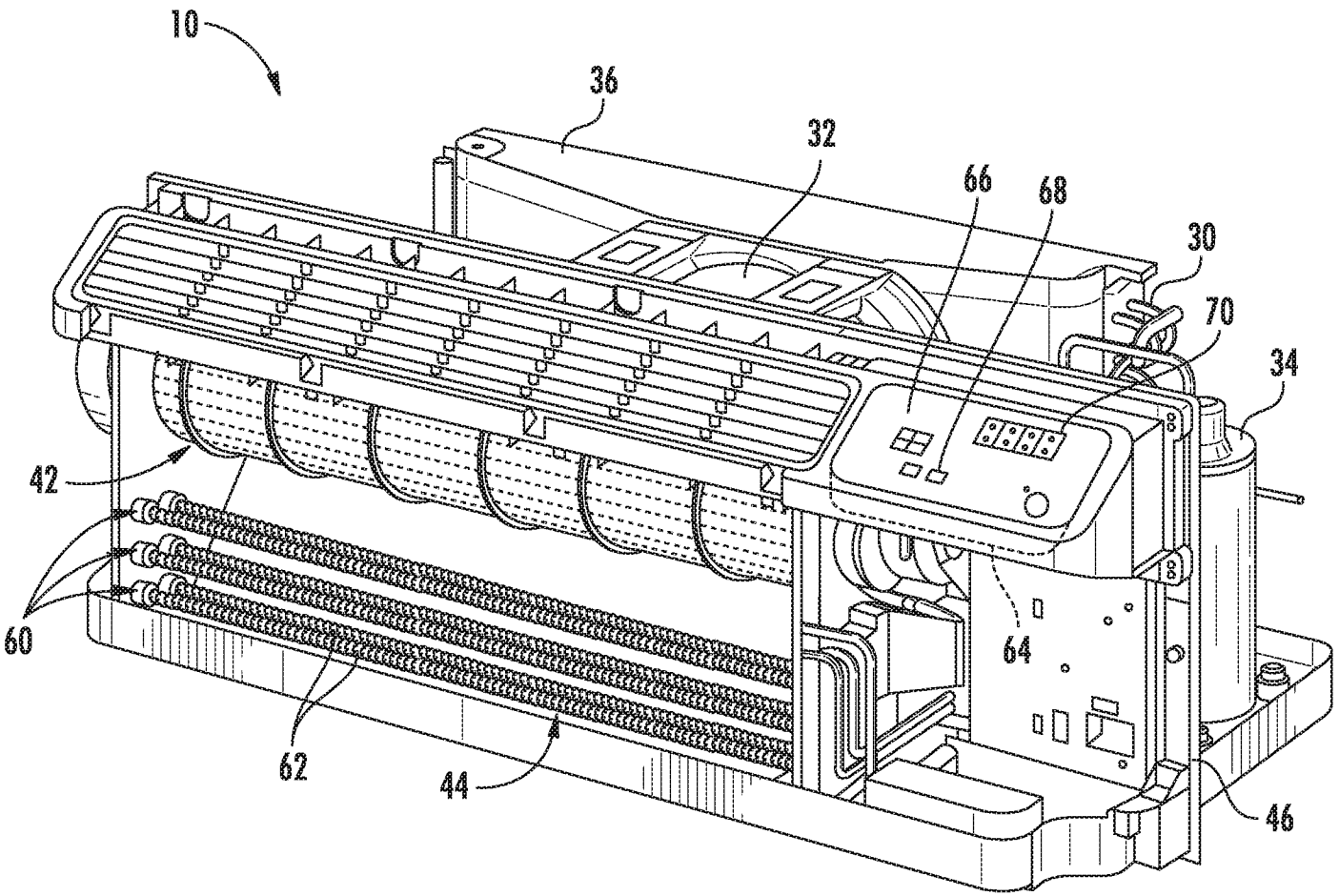
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
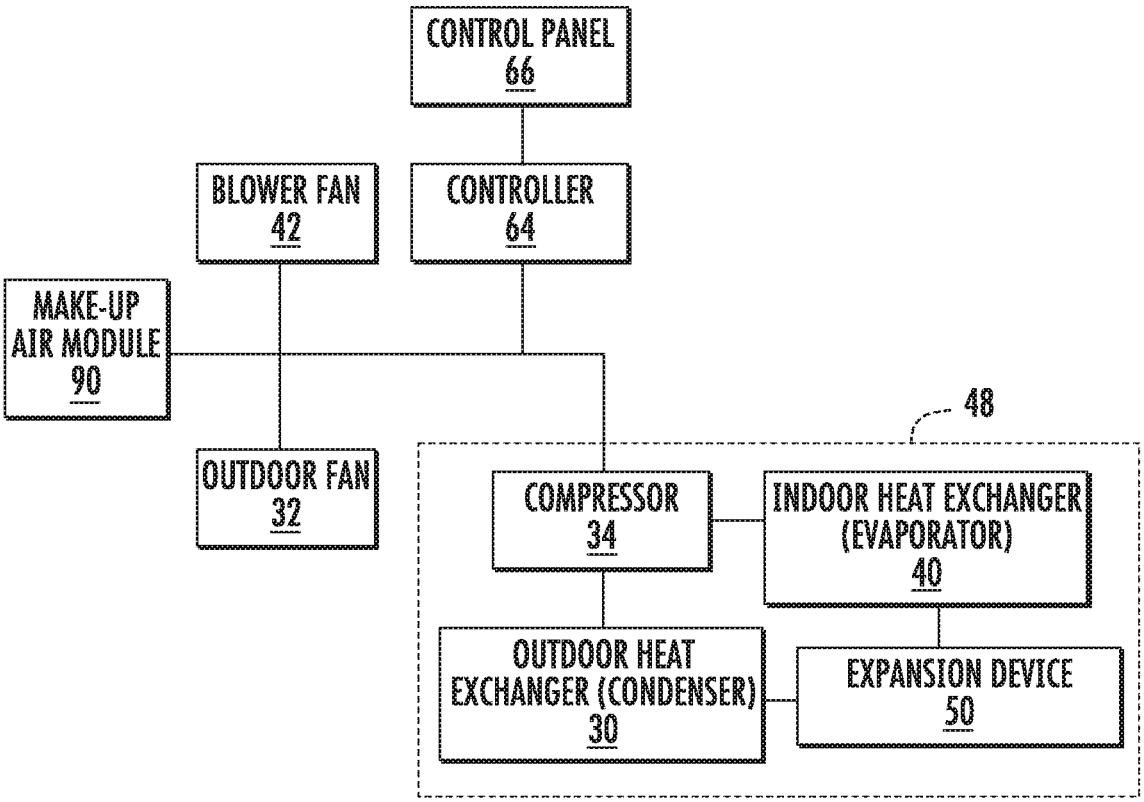
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. As described in more detail below with respect to FIG. 8, the controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
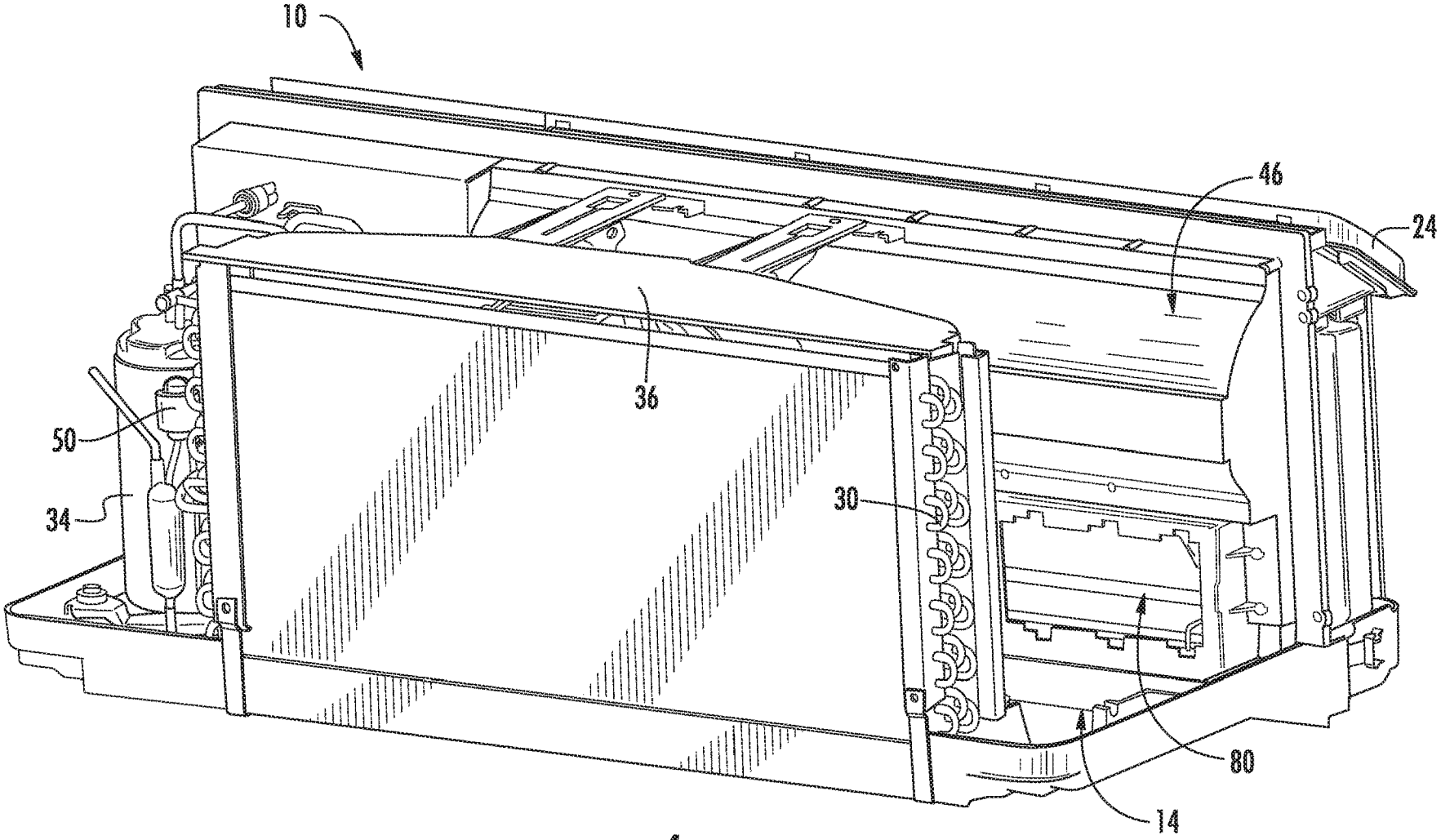
FIG. 4 is a rear perspective view of an outdoor portion of the exemplary air conditioner unit of FIG. 1, illustrating a vent aperture in a bulkhead assembly in accordance with one embodiment of the present disclosure.

Referring briefly to FIG. 4, a vent aperture 80 may be defined in bulkhead 46 providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
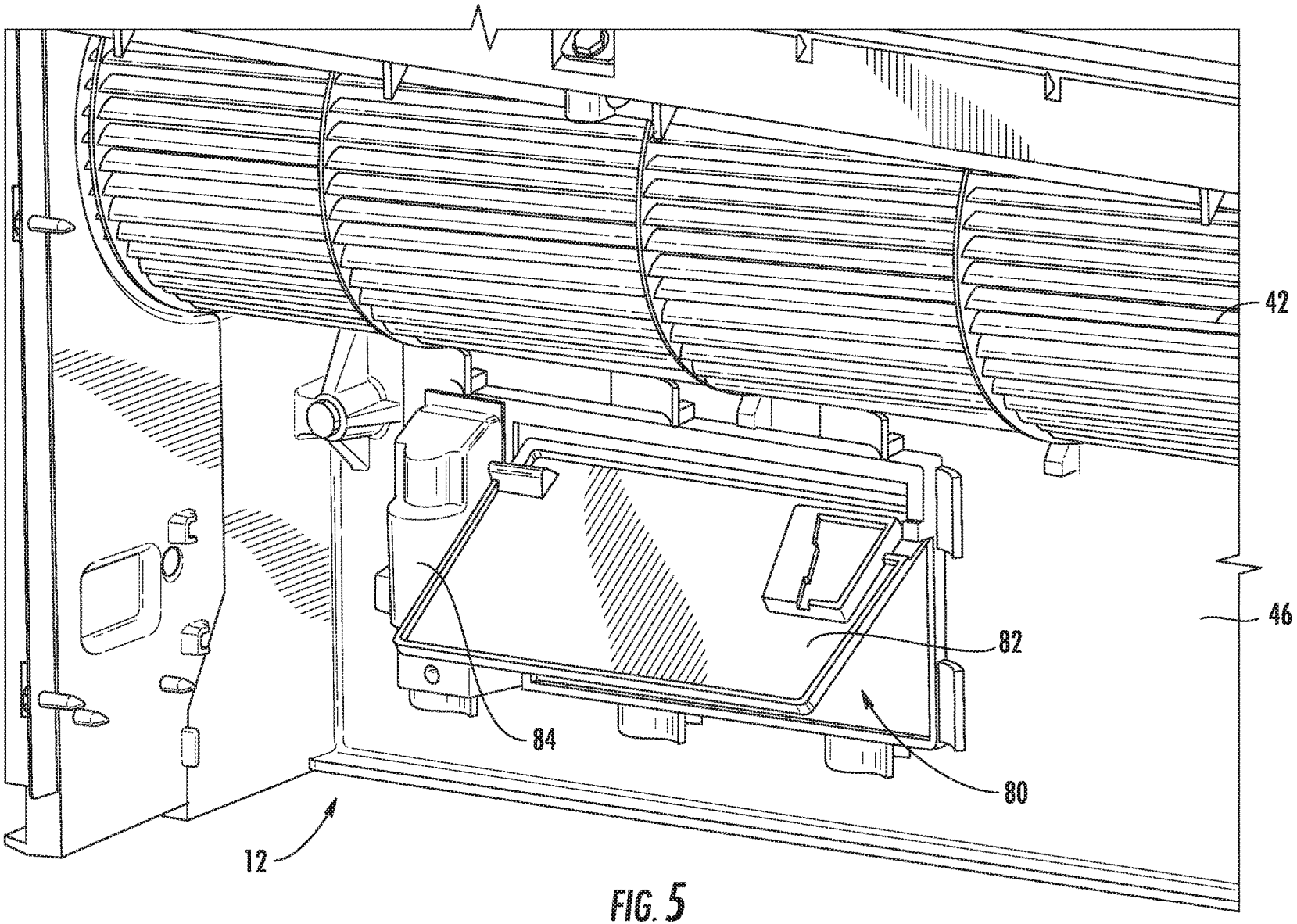
FIG. 5 is a front perspective view of the exemplary bulkhead assembly of FIG. 4 with a vent door illustrated in the open position in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
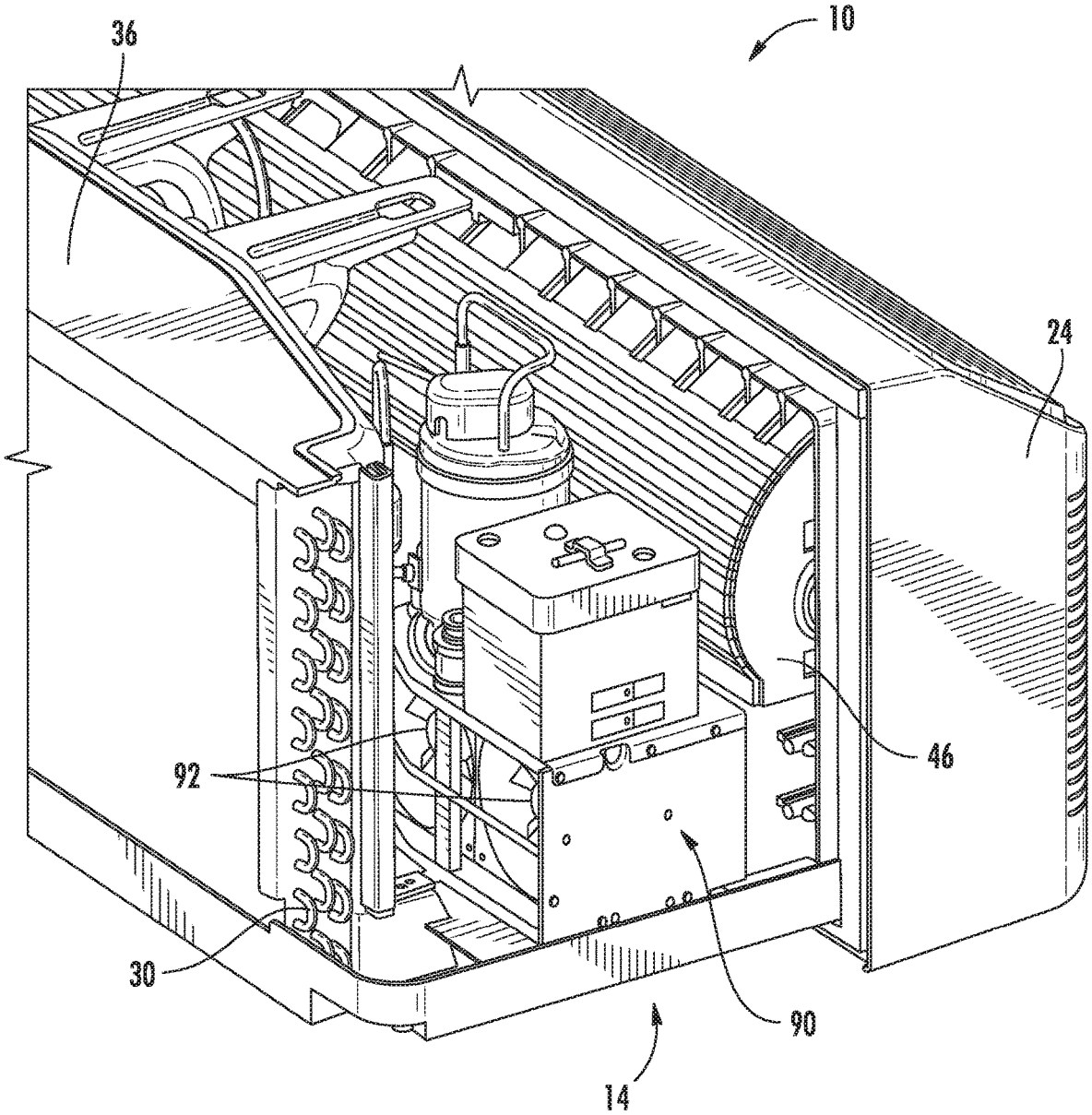
FIG. 6 is a rear perspective view of the exemplary air conditioner unit and bulkhead assembly of FIG. 4 including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air through auxiliary sealed system 90. Auxiliary sealed system 90 may further include one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Figure 7:
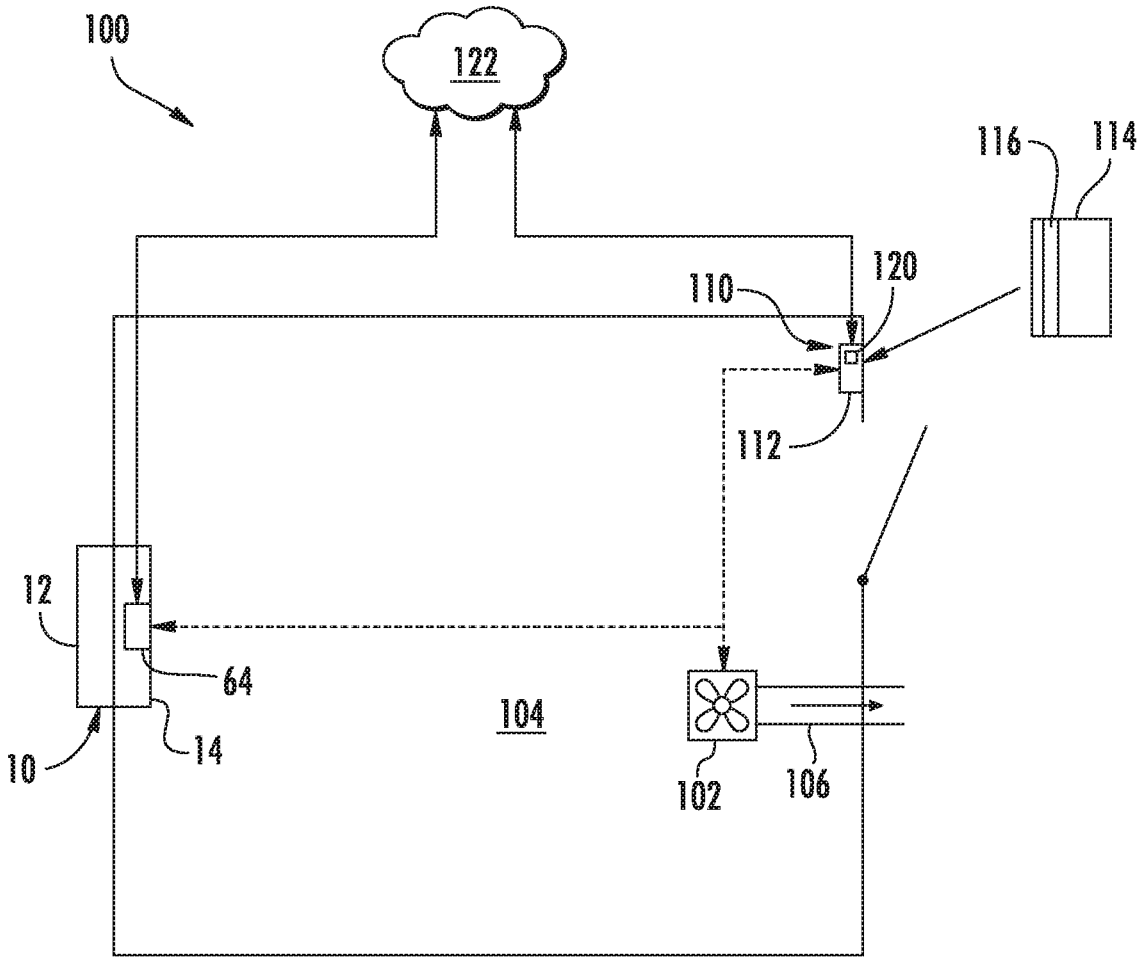
FIG. 7 is a schematic view of a control system used to operate an auxiliary fan and an exhaust fan of the exemplary air conditioner unit of FIG. 1 according to an exemplary embodiment of the present subject matter.

Referring now to FIG. 7, a control system 100 used to control an exhaust fan, an auxiliary fan, and/or a make-up air module of a packaged terminal air conditioner unit is described according to an exemplary embodiment. Using unit 10 as an example, control system 100 is generally used to selectively operate auxiliary fan 92 and/or an exhaust fan 102 to provide a flow of make-up air into a room 104 at a desired flow rate. Although control system 100 is described herein as one exemplary control system configuration for operating auxiliary fan 92 and/or exhaust fan 102, it should be appreciated that other configurations and control methodologies are possible while remaining within the scope of the present subject matter.

According to the illustrated embodiment, control system 100 includes a packaged terminal air conditioner unit, such as unit 10, positioned on an exterior wall of a room 104. Unit 10 is configured for conditioning air within room 104 and supplying a flow of make-up air into room 104, as described above. In this regard, for example, unit 10 includes auxiliary fan 92 positioned adjacent vent aperture 80 for urging a flow of auxiliary make-up air into room 104. In addition, control system 100 includes exhaust fan 102, such as a bathroom exhaust fan commonly found in hotel rooms. Exhaust fan 102 is in fluid communication with an exhaust duct 106 for discharging a flow of exhaust air through exhaust duct 106 at an exhaust flow rate.

Control system 100 further includes an occupancy system 110 generally configured for obtaining a room occupancy status. As used herein, "room occupancy status" may be used to refer to an indication that the room is occupied or unoccupied, to the number of room occupants, to the target make-up air flow rate, or any other information that may be used by the packaged terminal air conditioner unit 10 or make-up air module 90 to determine the proper make-up air flow rate.

Occupancy system 110 may include an identification reader such as a keycard reader 112 that is generally configured for reading an occupancy identification source, such as a keycard 114. More specifically, according to the exemplary illustrated embodiment, keycard reader 112 is positioned within room 104 near the door and keycard 114 includes a magnetic strip 116 that is configured to be read by the keycard reader 112. Upon entering the room, the guest puts keycard 114 into a slot of keycard reader 112. Keycard 114 may be encoded with information regarding the reserved room information as well as the number of guests staying in the room 104. The room occupancy status may be relayed to unit 10 and/or make-up air module 90 in any suitable manner.

The exemplary embodiment described above describes the room occupancy status and other information being relayed to make-up air module 90 using magnetic strip 116 on keycard 114. However, it should be appreciated that this information may be relayed using any other suitable method. For example, the room occupancy status may be entered by the guest using a keypad when they enter room 104, may be encoded in a barcode and read by a barcode scanner, may be communicated using a mobile phone application, may be transmitted using an RFID chip, may be obtained by in-room motion detectors and/or camera systems, or may be relayed in any other manner.

Occupancy system 110, including keycard reader 112 may be coupled to unit 10 through any suitable wired or wireless connection, as described in more detail below. For example, as illustrated, occupancy system 110 includes an occupancy system controller 120, e.g., housed within keycard reader 112, that is in operative communication with controller 64 of unit 10. More specifically, according to the illustrated embodiment, controller 64 and occupancy system controller 120 may be in communication with through a direct or indirect, wired or wireless connection, such as via a network 122. Similarly, exhaust fan 102 may have a dedicated controller and may be connected to network 122 and/or unit 10 through a suitable wired or wireless connection. In this regard, controller 64 of unit 10 is operably coupled, with occupancy system 110, auxiliary fan 92, and exhaust fan 102, and may be generally configured for performing methods described herein.

After the room occupancy status is received by unit 10, controller 64 determines a target make-up air flow rate. Notably, tying the target make-up air flow rate to occupancy system 110 and the number of room occupants, unit 10 may deliver the appropriate amount of air to meet government regulations and building codes, keep the noise created by auxiliary fan 92 to a minimum, and maintain guest comfort and satisfaction at a maximum.

FIG. 7 illustrates one exemplary configuration of control system 100 configured for controlling the operation of auxiliary fan 92 and/or exhaust fan 102 for the purpose of explaining aspects of the present subject matter. However, it should be appreciated that although specific exemplary embodiments are described, modifications and variations may be made to the illustrated control system 100 while remaining within the scope of the present subject matter. For example, controller 64 of unit 10 is illustrated as part of control system 100 for controlling operation of auxiliary fan 92 and/or exhaust fan 102. However, according to alternative embodiments, make-up air module 90 could include a dedicated controller. In addition, keycard reader 112 may be in operative communication with unit 10 and make-up air module 90 in any other suitable manner, e.g., through an in-room thermostat, through a direct wired connection, etc.

Figure 8:
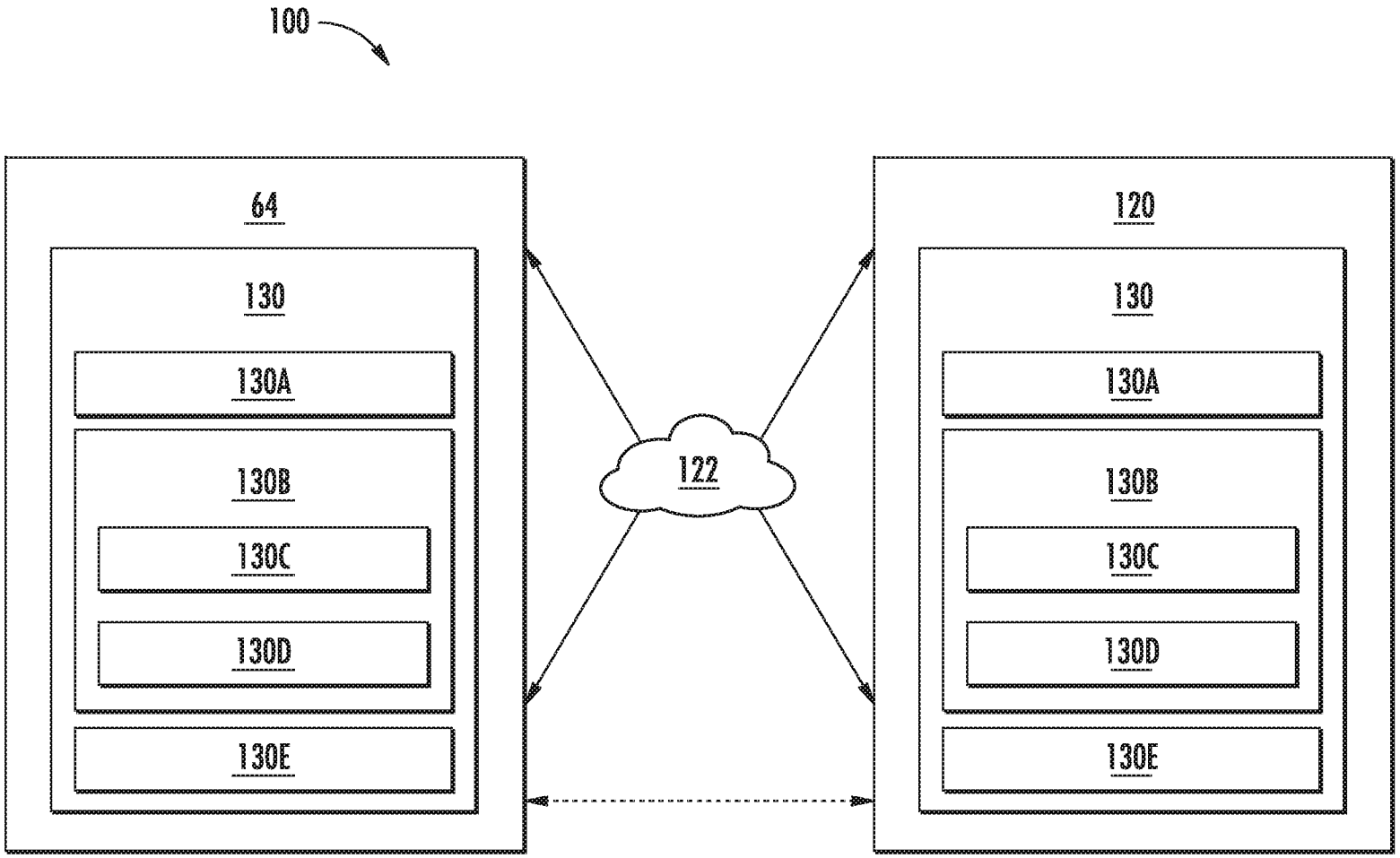
FIG. 8 depicts certain components of a control system according to example embodiments of the present subject matter.

FIG. 8 depicts certain components of control system 100 according to example embodiments of the present disclosure. As shown and described above, unit 10 includes controller 64 and occupancy system 110 includes occupancy system controller 120. Controllers 64 and 120 can be configured to communicate directly or via one or more network (s) (e.g., network(s) 122). Controllers 64 and 120 can include one or more computing device(s) 130. Although similar reference numerals will be used herein for describing the computing device(s) 130 associated with controllers 64 and 120 respectively, it should be appreciated that each of controllers 64 and 120 may have a dedicated computing device 130 not shared with the other. According to still another embodiment, only a single computing device 130 may be used to implement method 200 as described below, and that computing device 130 may be included as part of controllers 64 and 120.

Computing device(s) 130 can include one or more processor(s) 130A and one or more memory device(s) 130B. The one or more processor(s) 130A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 130B can include one or more non-transitory computer-readable storage medium(s), such as RAM, ROM, EEPROM, EPROM, flash memory devices, magnetic disks, etc., and/or combinations thereof.

The memory device(s) 130B can include one or more computer-readable media and can store information accessible by the one or more processor(s) 130A, including instructions 130C that can be executed by the one or more processor(s) 130A. For instance, the memory device(s) 130B can store instructions 130C for running one or more software applications, displaying a user interface, receiving user input, processing user input, etc. In some implementations, the instructions 130C can be executed by the one or more processor(s) 130A to cause the one or more processor (s) 130A to perform operations, as described herein (e.g., one or more portions of method 200). More specifically, for example, the instructions 130C may be executed to transmit and/or receive occupancy status information, determine a target make-up air flow rate, and adjust the speed of an auxiliary fan or an exhaust fan. The instructions 130C can be software written in any suitable programming language or can be implemented in hardware. Additionally, and/or alternatively, the instructions 130C can be executed in logically and/or virtually separate threads on processor(s) 130A.

The one or more memory device(s) 130B can also store data 130D that can be retrieved, manipulated, created, or stored by the one or more processor(s) 130A. The data 130D can include, for instance, data indicative of target make-up air flow rates for a given number of room occupants. The data 130D can be stored in one or more database(s). The one or more database(s) can be connected to controller 64 and/or controller 120 by a high bandwidth LAN or WAN, or can also be connected to controller through network(s) 122. The one or more database(s) can be split up so that they are located in multiple locales. In some implementations, the data 130D can be received from another device.

The computing device(s) 130 can also include a communication module or interface 130E used to communicate with one or more other component(s) of control system (e.g., controllers 64 and 120) over the network(s) 122. The communication interface 130E can include any suitable components for interfacing with one or more network(s), including for example, transmitters, receivers, ports, controllers, antennas, or other suitable components.

The network(s) 122 can be any type of communications network, such as a local area network (e.g. intranet), wide area network (e.g. Internet), cellular network, or some combination thereof and can include any number of wired and/or wireless links. The network(s) 122 can also include a direct connection between one or more component(s) of control system 100. In general, communication over the network(s) 122 can be carried via any type of wired and/or wireless connection, using a wide variety of communication protocols (e.g., TCP/IP, HTTP, SMTP, FTP), encodings or formats (e.g., HTML, XML), and/or protection schemes (e.g., VPN, secure HTTP, SSL).

The technology discussed herein makes reference to servers, databases, software applications, and other computer-based systems, as well as actions taken and information sent to and from such systems. It should be appreciated that the inherent flexibility of computer-based systems allows for a great variety of possible configurations, combinations, and divisions of tasks and functionality between and among components. For instance, computer processes discussed herein can be implemented using a single computing device or multiple computing devices (e.g., servers) working in combination. Databases and applications can be implemented on a single system or distributed across multiple systems. Distributed components can operate sequentially or in parallel. Furthermore, computing tasks discussed herein as being performed at the computing system (e.g., a server system) can instead be performed at a user computing device. Likewise, computing tasks discussed herein as being performed at the user computing device can instead be performed at the computing system.

Now that the construction of air conditioner unit 10 and the configuration of control system 100 according to exemplary embodiments has been presented, an exemplary method 200 of operating a packaged terminal air conditioner unit will be described. Although the discussion below refers to the exemplary method 200 of operating air conditioner unit 10, one skilled in the art will appreciate that the exemplary method 200 is applicable to the operation of a variety of other air conditioning appliances. In exemplary embodiments, the various method steps as disclosed herein may be performed by controller 64 or a separate, dedicated controller.

In general, unit 10 controls the delivery of make-up air into indoor portion 12 through vent aperture 80. More specifically, when vent door 82 is open, auxiliary fan 92 and/or exhaust fan 102 operate to urge make-up air into the room. More specifically, exhaust fan 102 may be referred to herein as urging a flow of exhaust air at an exhaust flow rate and auxiliary fan 92 may be referred to as urging a flow of auxiliary air at an auxiliary flow rate. According to the exemplary embodiment, the total flow rate of make-up air is the sum of the exhaust flow rate and the auxiliary flow rate. It should be appreciated that the terms "exhaust" flow and flow rate and "auxiliary" flow and flow rate are only intended to refer to the relative proportions/amounts of make-up air passing through vent aperture 80. Each of auxiliary fan 92 and exhaust fan 102 may be operated independently of each other or collectively to urge a flow of make-up air through vent aperture 80.

Figure 9:
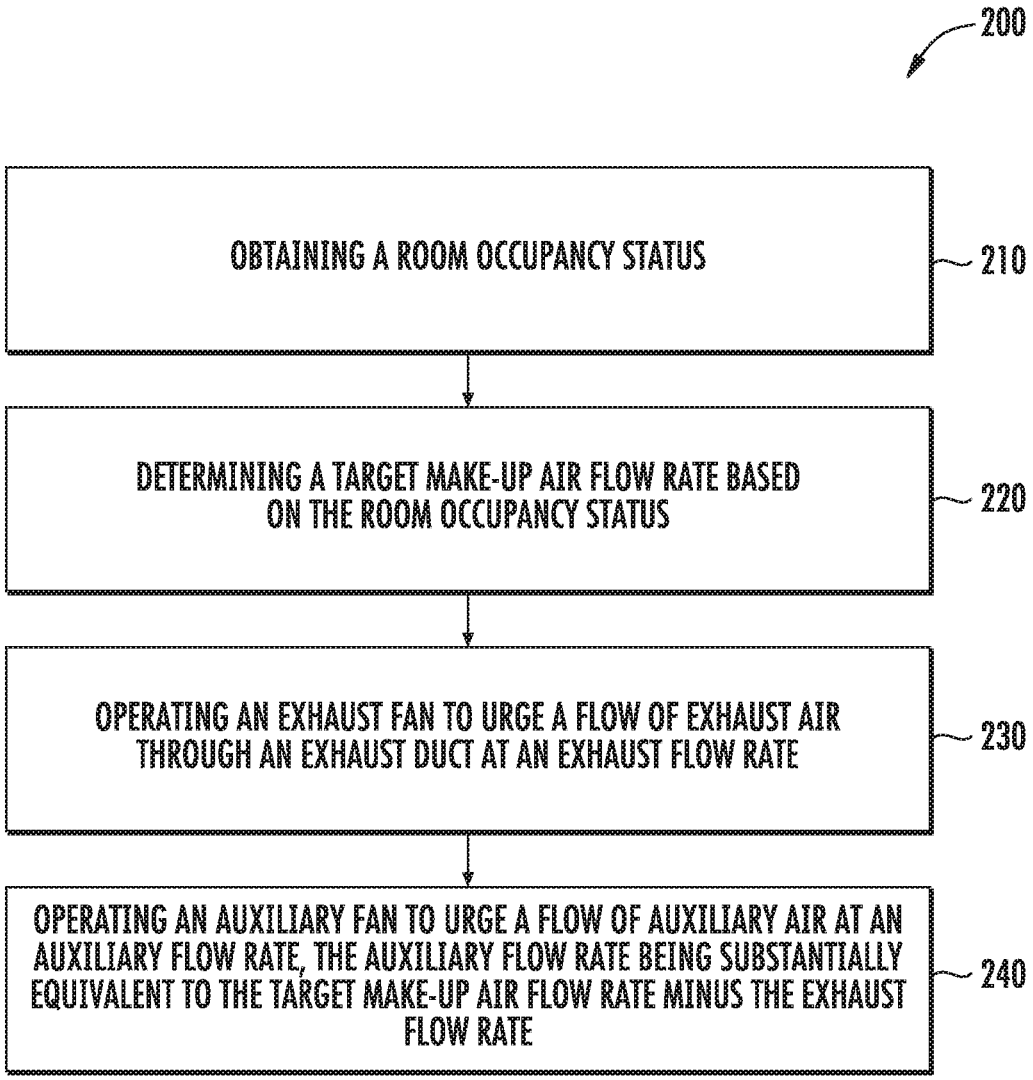
FIG. 9 illustrates a method for controlling a packaged terminal air conditioner unit in accordance with one embodiment of the present disclosure.

Referring now to FIG. 9, method 200 includes, at step 210, obtaining a room occupancy status. For example, the packaged terminal air conditioner unit may be in operative communication with an occupancy system or an occupancy reader, such as a key card reader, directly, through a thermostat, or through one or more wired or wireless networks. Step 220 includes determining a target make-up air flow rate based on the room occupancy status. Thus number of occupants in the room could be obtained using an occupancy system and the target make-up air flow rate may be calculated at least in part using the number of occupants in the room.

It should be appreciated that the number of room occupants may be one of many suitable criteria for determining the appropriate target make-up air flow rate. In addition, or alternatively, the make-up air flow rate may be based on the room size, a detected air pressure within the room, government regulations, or any other suitable factors. In general, the target make-up air flow rate is the desired flow rate of make-up air flowing into the room through the vent aperture to ensure guest comfort and meet any applicable government regulations.

Method 200 further includes, at step 230, operating an exhaust fan to urge a flow of exhaust air through an exhaust duct at an exhaust flow rate. In this regard, for example, an exhaust fan, such as a bathroom exhaust fan, can operate to discharge room air through an exhaust duct. Operation of the exhaust fan thus generally generates a negative pressure within the room. When the vent door is open, this negative pressure urges a flow of make-up air, i.e., the flow of exhaust air, through the vent aperture and into the room.

Method 200 further includes, at step 240, operating an auxiliary fan to urge a flow of auxiliary air at an auxiliary flow rate. According to an exemplary embodiment, the auxiliary flow rate is substantially equivalent to the target make-up air flow rate minus the exhaust flow rate. Thus, a sum of the exhaust flow rate and the auxiliary flow rate is substantially equivalent to the target make-up air flow rate so that the room receives the necessary flow rate of make-up air. In other words, according to aspects of the present subject matter, the exhaust fan and the auxiliary fan work together to supply make-up air at the target make-up air flow rate. In this manner, the exhaust fan may reduce the demand placed on the auxiliary fan, thereby reducing noise and energy usage while supplying the desired amount of make-up air.

For example, according to one exemplary embodiment, the occupancy system may determine that there are three room occupants and that the target make-up air flow rate is about fifty cubic feet per minute (CFM) in order to satisfy guest comfort and government regulations. The controller may determine that the exhaust fan is currently operating, and based on the exhaust fan speed, may determine that the exhaust flow rate is about fifteen CFM. The controller will then calculate that the auxiliary flow rate which must be supplied by the auxiliary fan to achieve the target make-up air flow rate is about thirty-five CFM, and will adjust the speed of the auxiliary fan accordingly. By contrast, if the occupancy system determines that the room is unoccupied, e.g., such that the target make-up air flow rate is zero, the controller may pivot the vent door to the closed position and turn the auxiliary fan off to conserve energy. It should be appreciated that these are only exemplary manners of operating the packaged terminal air conditioner unit and are not intended to limit the scope of the present subject matter.

FIG. 9 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using unit 10 as an example, it should be appreciated that this method may be applied to operate suitable air conditioner unit.

According to alternative embodiments, method 200 may further be used to operate a packaged terminal air conditioner unit to achieve various alternative goals. For example, according to an alternative embodiment, the auxiliary fan may have a maximum flow rate or it may be desirable to select and arbitrary maximum flow rate which the auxiliary fan should not exceed. The maximum flow rate could be a flow rate where the auxiliary fan operates at its most energy efficient operating point or at a specific energy consumption level.

According to such an embodiment, the PTAC controller may be configured for determining that the target make-up air flow rate is greater than the maximum flow rate of the auxiliary fan. Upon making such a determination, the controller may operate the auxiliary fan to urge the flow of auxiliary make-up air at the maximum flow rate. Finally, in order to meet the target make-up air flow rate, the controller may be configured for operating the exhaust fan such that the exhaust flow rate is substantially equivalent to the target make-up air flow rate minus the maximum flow rate. In this manner, a predetermined operating threshold such as the maximum flow rate of the auxiliary fan may be maintained while the exhaust fan is controlled as necessary to achieve the target make-up air flow rate.

It should be appreciated that such a control method may also be used to place limits on the operation of the exhaust fan. More specifically, controller may set a maximum exhaust flow rate and auxiliary fan may be selectively operated to supply auxiliary make-up air at an auxiliary flow rate sufficient to meet the target make-up air flow rate. In addition, the predetermined operating threshold, whether it is selected for the exhaust fan or the auxiliary fan, may be set for any particular purpose. For example, the auxiliary fan may be operated at a noise-limiting flow rate where the noise generated by the auxiliary fan reaches, but does not exceed a predetermined noise threshold. In this manner, when auxiliary fan begins to generate too much noise, the exhaust fan can begin to supply the extra make-up air without the operation of the unit exceeding an undesirable noise level.

According to another exemplary embodiment, the auxiliary fan may remain off altogether if operation of the exhaust fan draws a sufficient amount of make-up air into the room. For example, if the controller determines that a maximum flow rate of the exhaust fan is greater than the target make-up air flow rate, the auxiliary fan may be turned off and the exhaust fan may be operated at the target make-up air flow rate. In addition, according to alternative embodiments, other means can be used to assist in drawing make-up air through the vent aperture, such as indoor fan 42 of unit 10, which has a tendency to draw additional make-up air through vent aperture 80 when operating.

The construction of packaged terminal air conditioner unit 10, control system 100, and methods 200 described above provide a means for ensuring that auxiliary fan 92 and exhaust fan 102 work together to ensure that the necessary amount of make-up air is provided while minimizing noise and energy usage. Thus, for example, if the target make-up air flow rate is higher than a maximum flow rate of the auxiliary fan or the auxiliary fan is operating at a noise level that is above a predetermined threshold, the exhaust fan may operate to boost the make-up air flow rate, thereby reducing the load placed on the auxiliary fan. In addition, decreasing the auxiliary fan speed when the exhaust fan is operating can save energy while maintaining the target make-up air flow rate. Thus, coordinated operation of the auxiliary fan and the exhaust fan may result in improved guest comfort, minimized energy usage, and the elimination of unnecessary noise from an auxiliary fan operating at higher than necessary speeds.

In this manner, unit 10 and auxiliary fan 92 provide the appropriate amount of air to meet government regulations and building codes, keeps the noise created by make-up air module 90 to a minimum, and maintains guest comfort and satisfaction at a maximum. In addition, by operatively connecting unit 10 with control system 100 and its associated occupancy system 110, the target make-up air flow rate may be automatically adjusted to provide the required amount of make-up air without requiring a facility operator to make a manual change to the setting in each unit 10 when each guest or guests check into their room.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit comprising:
a bulkhead defining an indoor portion and an outdoor portion;
a vent aperture defined in the bulkhead;
an auxiliary fan positioned proximate the vent aperture; and
a controller configured to be operably coupled to an occupancy system, the auxiliary fan, and an exhaust fan, the controller being configured for:
obtaining a room occupancy status from the occupancy system;
determining a target make-up air flow rate based on the room occupancy status;
operating the auxiliary fan;
determining that the exhaust fan is operating to urge a flow of exhaust air through an exhaust duct at an exhaust flow rate; and
reducing a speed of the auxiliary fan to urge a flow of auxiliary air at an auxiliary flow rate such that a sum of the exhaust flow rate and the auxiliary flow rate is equivalent to the target make-up air flow rate, wherein the auxiliary flow rate, the target make-up air flow rate, and the exhaust flow rate are all positive flow rates and the target make-up air flow rate is greater than or equal to the exhaust flow rate.

2. The packaged terminal air conditioner unit of claim 1, wherein the controller is further configured for:
determining that the target make-up air flow rate is greater than a maximum flow rate of the auxiliary fan; and
operating the auxiliary fan to urge the flow of auxiliary air at the maximum flow rate.

3. The packaged terminal air conditioner unit of claim 1, wherein the controller is further configured for:
determining that the target make-up air flow rate is greater than a noise-limiting flow rate of the auxiliary fan where the noise generated by the auxiliary fan reaches a predetermined noise threshold; and
operating the auxiliary fan to urge the flow of auxiliary air at the noise-limiting flow rate.

4. The packaged terminal air conditioner unit of claim 1, further comprising:
a vent door positioned proximate the vent aperture, the vent door being pivotable between an open position for allowing a flow of make-up air through the vent aperture and a closed position for blocking the flow of make-up air through the vent aperture.

5. The packaged terminal air conditioner unit of claim 4, wherein the controller is further configured for:
determining that the target make-up air flow rate is zero; and
closing the vent door and turning off the auxiliary fan in response to determining that the target make-up air flow rate is zero.

6. The packaged terminal air conditioner unit of claim 1, wherein the controller comprises a wireless communication module in wireless communication with the exhaust fan and the occupancy system.

7. A method of operating a packaged terminal air conditioner unit, the packaged terminal conditioner unit comprising an auxiliary fan positioned proximate a vent aperture defined in a bulkhead of the packaged terminal air conditioner unit, the method comprising:
obtaining a room occupancy status;
determining a target make-up air flow rate based on the room occupancy status;
operating the auxiliary fan;
determining that an exhaust fan is operating to urge a flow of exhaust air through an exhaust duct at an exhaust flow rate; and
reducing a speed of the auxiliary fan to urge a flow of auxiliary air at an auxiliary flow rate such that a sum of the exhaust flow rate and the auxiliary flow rate is equivalent to the target make-up air flow rate, wherein the auxiliary flow rate, the target make-up air flow rate, and the exhaust flow rate are all positive flow rates.

8. The method of claim 7, further comprising:
determining that the target make-up air flow rate is greater than a maximum flow rate of the auxiliary fan; and
operating the auxiliary fan to urge the flow of auxiliary air at the maximum flow rate.

9. The method of claim 7, further comprising:
determining that the target make-up air flow rate is greater than a noise-limiting flow rate of the auxiliary fan where the noise generated by the auxiliary fan reaches a predetermined noise threshold; and
operating the auxiliary fan to urge the flow of auxiliary air at the noise-limiting flow rate.

10. The method of claim 7, wherein the packaged terminal air conditioner unit further comprises a vent door positioned proximate the vent aperture, the vent door being pivotable between an open position for allowing a flow of make-up air through the vent aperture and a closed position for blocking the flow of make-up air through the vent aperture, the method further comprising:
determining that the target make-up air flow rate is zero; and
closing the vent door and turning off the auxiliary fan in response to determining that the target make-up air flow rate is zero.

11. The method of claim 7, wherein the target make-up air flow rate is greater than or equal to the exhaust flow rate.

12. An air conditioning system for a room, the air conditioning system comprising:
a packaged terminal conditioner unit comprising an auxiliary fan positioned adjacent a vent aperture defined in a bulkhead of the packaged terminal air conditioner unit;
an exhaust fan positioned within the room and being in fluid communication with an exhaust duct;
an occupancy system for determining a room occupancy status; and
a controller configured for:
obtaining the room occupancy status from the occupancy system;
determining a target make-up air flow rate based on the room occupancy status;
operating the auxiliary fan;
determining that the exhaust fan is urging a flow of exhaust air through the exhaust duct at an exhaust flow rate; and
reducing a speed of the auxiliary fan to urge a flow of auxiliary air at an auxiliary flow rate such that a sum of the exhaust flow rate and the auxiliary flow rate is equivalent to the target make-up air flow rate, wherein the auxiliary flow rate, the target make-up air flow rate, and the exhaust flow rate are all positive flow rates.

13. The air conditioning system of claim 12, wherein the controller is further configured for:

determining that the target make-up air flow rate is greater than a maximum flow rate of the auxiliary fan;

operating the auxiliary fan to urge the flow of auxiliary air at the maximum flow rate; and operating the exhaust fan to urge the flow of exhaust air at the exhaust flow rate, the exhaust flow rate being equivalent to the target make-up air flow rate minus the maximum flow rate.

14. The air conditioning system of claim 12, wherein the controller is further configured for:

determining that the target make-up air flow rate is greater than a noise-limiting flow rate of the auxiliary fan where the noise generated by the auxiliary fan reaches a predetermined noise threshold;

operating the auxiliary fan to urge the flow of auxiliary air at the noise-limiting flow rate; and operating the exhaust fan to urge the flow of exhaust air at the exhaust flow rate, the exhaust flow rate being equivalent to the target make-up air flow rate minus the noise-limiting flow rate.

15. The air conditioning system of claim 12, wherein the controller is further configured for:

determining that a maximum flow rate of the exhaust fan is greater than the target make-up air flow rate; and turning off the auxiliary fan and operating the exhaust fan at the target make-up air flow rate in response to determining that the maximum flow rate of the exhaust fan is greater than the target make-up air flow rate.

16. The air conditioning system of claim 12, wherein the air conditioning system further comprises a vent door positioned proximate the vent aperture, the vent door being pivotable between an open position for allowing a flow of make-up air through the vent aperture and a closed position for blocking the flow of make-up air through the vent aperture, and wherein the controller is further configured for:

determining that the target make-up air flow rate is zero; and closing the vent door and turning off the auxiliary fan in response to determining that the target make-up air flow rate is zero.

17. The air conditioning system of claim 12, wherein the occupancy system comprises:

an occupancy identification source including data indicative of the room occupancy status; and an occupancy reader configured for reading the occupancy identification source to determine the room occupancy status, wherein the controller is configured for operating the auxiliary fan and the exhaust fan based at least in part on the room occupancy status determined by the occupancy reader.

18. The air conditioning system of claim 12, wherein the target make-up air flow rate is greater than or equal to the exhaust flow rate.

* * * * *